United States Patent [19]

Partanen

[11] Patent Number: 5,074,964

[45] Date of Patent: Dec. 24, 1991

[54] WEB FORMING APPARATUS HAVING A DOUBLE WIRE SECTION

[75] Inventor: Hannu Partanen, Kotka, Finland

[73] Assignee: Valmet-Ahlstrom Inc., Karhula, Finland

[21] Appl. No.: 516,352

[22] Filed: Apr. 30, 1990

[30] Foreign Application Priority Data

May 8, 1989 [FI] Finland ..... 892198

[51] Int. Cl.[5] ..... D21F 11/02; D21F 11/04

[52] U.S. Cl. ..... 162/203; 162/300; 162/301; 162/303; 162/352

[58] Field of Search ..... 162/300, 301, 303, 352, 162/203

[56] References Cited

U.S. PATENT DOCUMENTS

| | | | |
|---|---|---|---|
| 3,772,145 | 11/1973 | Notbohm | 162/301 |
| 4,414,061 | 11/1983 | Trufitt et al. | 162/301 |
| 4,523,978 | 6/1985 | Pullinen | 162/300 |
| 4,769,111 | 9/1988 | Nevelainen | 162/300 |
| 4,923,568 | 5/1990 | Hietikko et al. | 162/301 |

FOREIGN PATENT DOCUMENTS

| | | | |
|---|---|---|---|
| 122702 | 10/1984 | European Pat. Off. . | |
| 821531 | 10/1983 | Finland . | |
| 840902 | 9/1984 | Finland . | |
| 842918 | 1/1985 | Finland . | |
| 851035 | 11/1985 | Finland . | |
| 0050609 | 4/1979 | Japan | 162/301 |
| 2069896 | 3/1987 | Japan | 162/300 |
| 2143761 | 2/1985 | United Kingdom . | |

*Primary Examiner*—Richard V. Fisher
*Assistant Examiner*—Brenda Lamb
*Attorney, Agent, or Firm*—Nixon & Vanderhye

[57] ABSTRACT

The present invention relates to an apparatus for forming fibrous paper or board web on a double wire section of a paper machine. The double wire section includes a first wire loop and a second wire loop. In a first dewatering zone of the double wire section where the paths of both wire loops are substantially linear, the web direction is adjustably deviated towards the second wire loop. In a second dewatering zone located after the first dewatering zone, the web is curved towards the first wire loop to form a curved dewatering zone. In the linear dewatering zone, the second wire loop is loaded towards the first wire loop with wire support members. In the curved dewatering zone, the compression between the wires is effected by adjustably tightening the wires.

5 Claims, 4 Drawing Sheets

WEB FORMING APPARATUS HAVING A DOUBLE WIRE SECTION

The present invention relates to a method for forming fibrous paper or board web in a double wire section of a paper machine or equivalent, the said double wire section comprising a first wire loop and a second wire loop in conjunction with it, and in which method the fiber suspension flowing out of a paper machine headbox is fed either onto the Fourdrinier section before the double wire section, the said Fourdrinier section being part of the said second wire loop, and on which Fourdrinier section water is removed from the fiber suspension through the said second wire before it is conducted to the double wire section, or the fiber suspension is fed at headbox consistency immediately into the double wire section in the gap between the two wire loops wherein water is removed from fiber suspension by means of a dewatering unit arranged inside the first wire loop which drains water through the said first wire, after which the first wire loop is separated from the formed.web which is then guided to follow the run of the second wire loop for further processing.

The present invention also relates to an apparatus for forming fibrous paper or board web, which apparatus comprises a double wire section consisting of a first wire loop and a second wire loop in conjunction with it and at least one headbox which is arranged to feed fiber suspension either onto the fourdrinier section before the double wire section or at headbox consistency immediately into the double wire section in the gap between the wire loops, and in which the first wire loop is equipped with a dewatering unit which, by means of underpressure, drains water through the first wire from the fiber suspension between the wire loops.

In the oldest continuous paper or board web forming methods which still are most commonly applied, web is formed on a horizontal Fourdrinier section. In these methods water is removed from fiber suspension only downwards on the whole length of the wire section. Due to the operating principle of such a wire section, the top and bottom surfaces of the produced paper differ from each other. The top surface of the paper is smoother than the bottom surface, on which the wire marking caused by the former wire can clearly be seen. Also the fiber composition of the top and bottom surface of the paper is different, since the top surface of the web contains significantly more fine and short fibers and fillers than the bottom surface from which a considerable amount of the fines has been flushed away during the downwards dewatering. The difference between the top and bottom surfaces of paper is no problem in e.g. wrapping papers or packing board. It is, however, essential that both surfaces of papers intended to be used in printing of books and newspapers have equal fiber composition and similar properties. The difference between the two paper surfaces is called two-sidedness.

There are several previously known paper machine concepts which have been specifically designed to reduce the two-sidedness of the paper to be manufactured. They can be divided into two main categories: actual double wire formers and so called hybrid formers. In actual double wire formers web is formed between two wires from beginning to end. When hybrid formers are used, web is first formed on one wire after which the partly formed web is conducted to the dewatering zone between two wires for the final formation.

An advantage of hybrid formers is that they can be converted of existing Fourdrinier wire sections with rather simple changes. The most essential change is the placing of the top wire loop on the middle or end section of the upper side of the bottom wire. In addition to paper quality improvement, the dewatering on the wire section is thus made more effective and also the speed of the paper machine is increased. A significant disadvantage of the above formers is their unsuitability for thick paper and board grades. This is due to the fact that at the beginning point of the double wire section, which is located after the single wire dewatering zone, the run of the wires and that of the fiber layer between the wires are guided immediately to curve rather steeply over the surface of a so called stationary forming shoe or over a rotating roll. The curved path causes internal tension in the web, and the greater the tension, the thicker the web. Thus, dewatering pressure is exerted to the fiber layer between the wires which pressure is directly proportional to the tension of the outer wire and inversely proportional to the radius of curvature of the said surface. Due to space and constructional factors, in the known hybrid formers the radius of curvature of either the shoe or the roll is so small that the sudden compression effect exerted to the web to be formed at this stage is too dense in case thick paper or board grades are in question. Too strong compression damages fiber layers and deteriorates the properties of the product, especially strength properties, but also printing properties. In the worst case too strong compression will cause production breaks.

The objective of the present invention is to introduce a web forming method and device which eliminate the disadvantages connected to the above techniques, and by means of which a considerable improvement is achieved. To accomplish the above mentioned objective and also some further objectives, the method according to the invention is mainly characterized in that before the first dewatering zone of the double wire section, on which the runs of the both wire loops are substantially linear, the moving direction of the web is adjustably deviated towards the second wire loop, and in that on the second dewatering towards the first wire loop in such a way that, on the linear dewatering zone, the second wire loop is surface loaded against the first wire loop with wire support members, and that on the curved dewatering zone, the compression between the wires is achieved by adjustably stretching the wires.

The apparatus according to the invention is mainly characterized in that two consecutive dewatering zones are arranged on the dewatering unit range in such a way that on the first dewatering zone, on which the runs of the both wire loops are substantially linear, the moving direction of the web is deviated from the dewatering unit and that on the second dewatering zone the moving direction of the web is conducted curvedly again towards the dewatering unit at the first point using a break back roll or a curved shoe, and at the second point a curved shoe.

Several advantages are gained with the present invention compared to the prior art techniques. In the double wire section, which is an essential part of the invention, the web between the wires can easily be formed and, in addition, the angle of the gap between the wires can be adjusted. As a result, the method and the apparatus according to the invention are suitable for very wide basis weight and speed ranges. Due to the construction of the apparatus according to the invention, the method and the apparatus are also suitable for very high web speeds. The other advantages and characteristics of the invention are given in more detail in the description below, but within the scope of which the invention is not, however, limited.

In the following the invention is described, by way of an example, with reference to the accompanying drawings.

Figure 1:
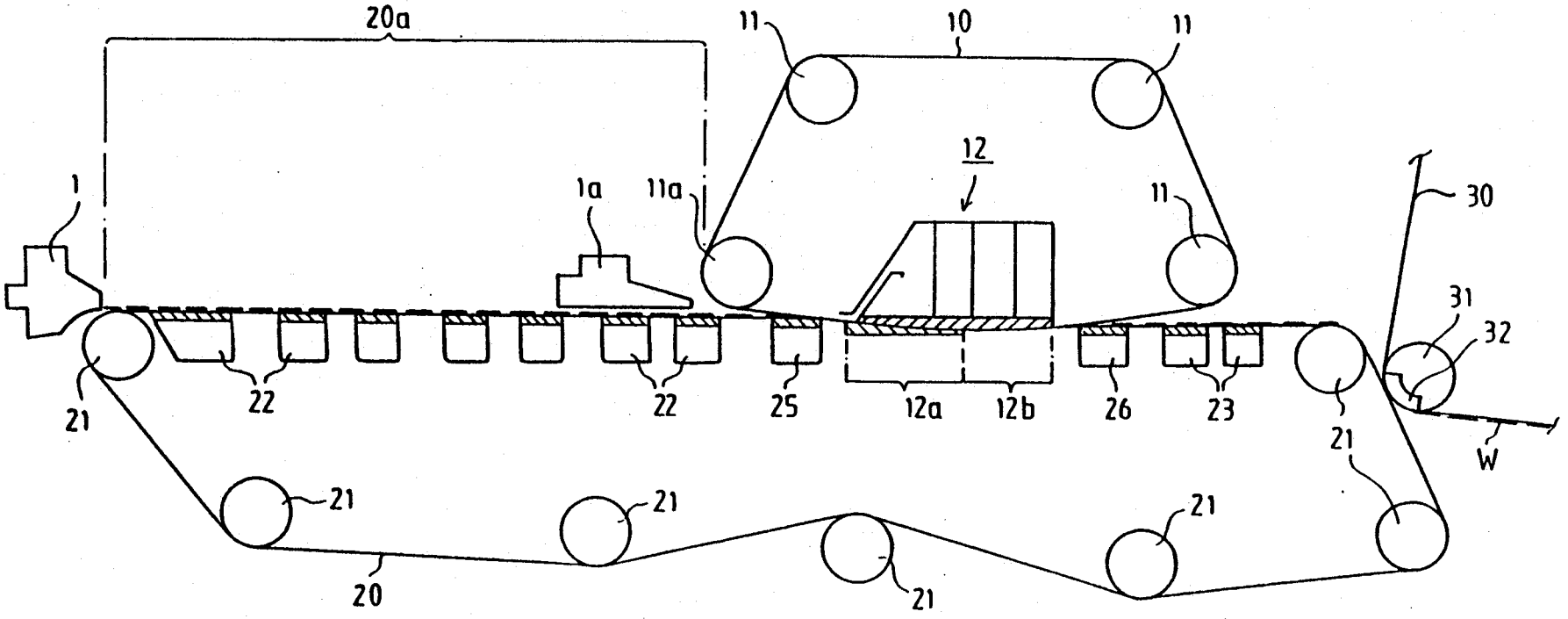
FIG. 1 is a schematic side elevation of an embodiment of the web forming apparatus according to the invention.

The preferred embodiment of the web forming apparatus according to FIG. 1 comprises a headbox 1, a first wire loop 10 and a second wire loop 20. The run of the first wire loop is guided by lead rolls 11 and an adjustable guide roll 11*a*, and correspondingly, the run of the second wire loop is guided by lead rolls 21. The embodiment in FIG. 1 is a so called Fourdrinier wire application in which the headbox 1 feeds the stock to the Fourdrinier section 20*a* of the second wire loop 20, where water is drained from the stock with dewatering equipment 22. The fiber layer W, i.e. web, which has been formed on the second wire loop 20, continues its way to the double wire section which, in the embodiment of FIG. 1, comprises the space between the first wire loop 10 and the second wire loop 20. In the beginning of the double wire section, the top wire loop 10 and the bottom wire loop 20 create a tapered gap, where the top wire loop 10 is conducted close to the bottom wire loop 20 in a small angle, e.g. 2°–5°. Inside the first wire loop 10 a dewatering unit 12 is located, by means of which water is removed from web W through the first wire 10 towards the dewatering unit 12. On the opposite side of both wires, just before the range of the dewatering unit 12, a box 25 is arranged, which, due to its curved top, guides the second wire loop 20 and the web W to the range of the dewatering unit 12. The dewatering unit 12 is divided into two dewatering zones or portions, i.e. the first or the linear zone 12*a* and the following second or the curved zone 12*b*. The structure and the operation of these zones will be described in connection with FIG. 2 in which the double wire section of the web forming apparatus is described in more detail. Downstream the web travel after the dewatering unit underneath the second wire loop 20, a suction box 26 is arranged, which is a so called pick-up suction box, which ensures that web W follows the surface of the second wire loop 20 after the double wire section. In the embodiment of FIG. 1, the second wire loop 20 is further equipped with dewatering equipment 23, e.g. suction boxes, which further remove water from web W. Web W, formed with a web forming apparatus according to FIG. 1, is then separated from the second wire loop 20, for example by means of a pick-up roll 31 equipped with the suction zone 32 and adhered to the bottom surface of the pick-up felt 30 which brings the web W from the wire section to the press section (not illustrated).

As mentioned earlier, the headbox 1 feeds stock first on the Fourdrinier wire section 20*a* where water is removed from stock and after which stock moves to the double wire section of the web forming apparatus. According to this invention, however, it is also possible to feed the stock at the headbox consistency directly into the tapered gap between the wire loops 10 and 20. This has been illustrated in FIG. 1 with the headbox referred to as 1*a* which, as an application such as this, is thus an alternative embodiment to the headbox 1. The third alternative embodiment in FIG. 1 is as follows: the first headbox 1 is a so called primary headboxy by means of which stock is fed onto the Fourdrinier wire section 20*a* through which water is removed from stock, and stock reaches the desired consistency before entering the double wire section. An additional layer of stock is directly fed into the gap between the wire loops by means of a second headbox (1*a*), a so called secondary headbox. Stock is conducted into the double wire section in the form of layers in such a way that the stock against the second wire loop 20 is dryer than the stock against the first wire loop 10.

Figure 2:
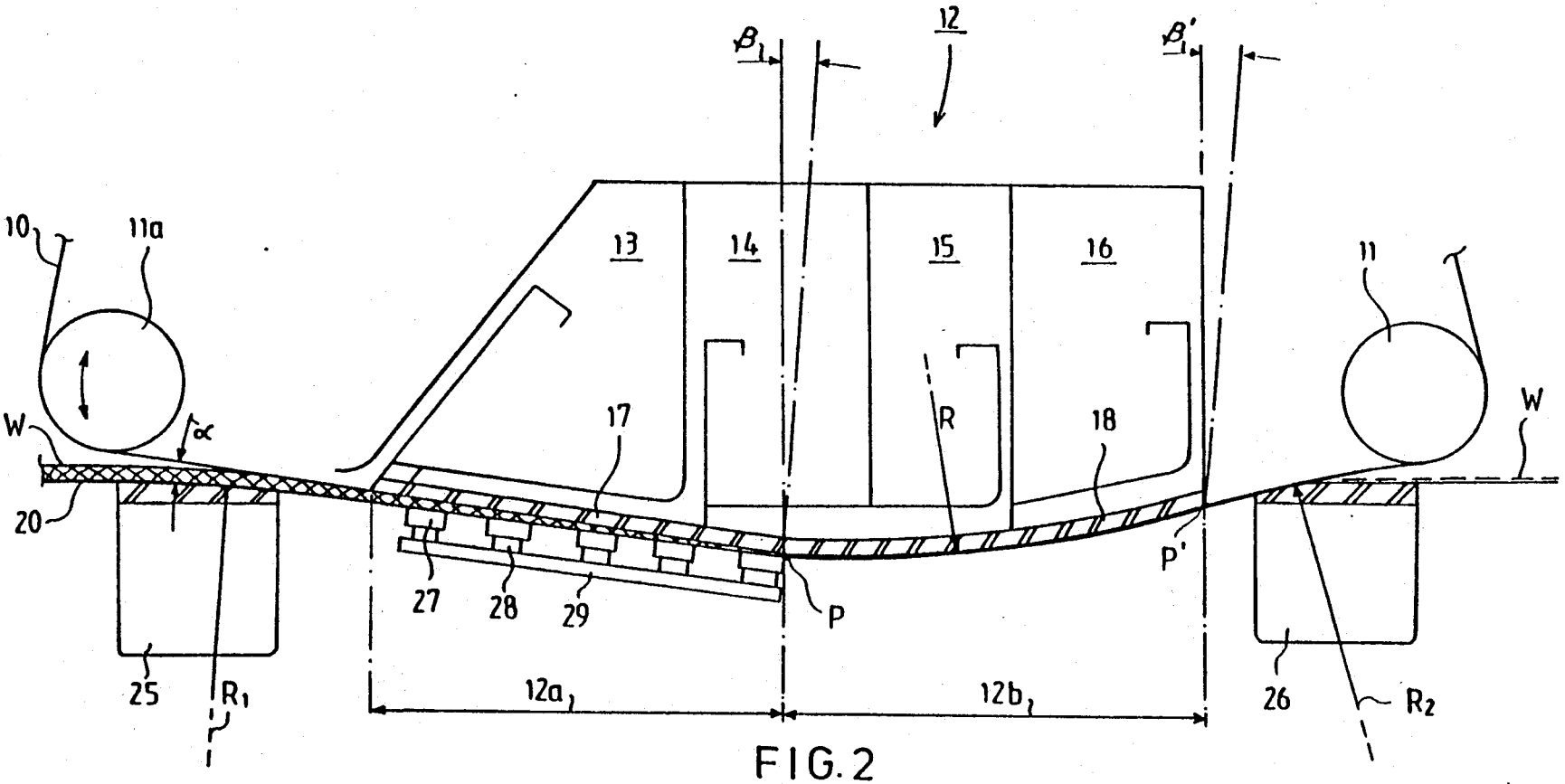
FIG. 2 illustrates the double wire section of the web forming apparatus according to FIG. 1 more in detail.

FIG. 2 illustrates the structure and operation of the web forming apparatus according to the invention in more detail. As described earlier, the web W moves into the tapered gap between the wire loops 10 and 20 guided by the second wire loop 20. The said gap is created of the first and second wire loops 10 and 20 in such a way that the wire loops are arranged in a small angle $\alpha$ with respect to one another which angle can be adjusted preferably to 2°–5°. The angle $\alpha$ can be adjusted by adjusting the vertical position of the guide roll 11*a* of the first wire loop 10 (indicated by an arrow). The path of the web is deviated towards the wire 20 in the range of the said tapered gap using the suction box 25 equipped with a curved top. When the web enters the linear zone 12*a* of the dewatering unit, it is slightly directed downwards (FIGS. 1 and 2) by using a slightly curved top on the suction box 25 with a radius R1. This radius is selected so that it guides the web smoothly without excessive pressure shock to the linear dewatering zone 12*a*. The structure of the actual dewatering unit 12 is rather conventional comprising several chambers 13–16 into which water is drained from the stock by means of underpressure prevailing in chambers 13–16. Different levels of vacuum can preferably be used in different chambers. In the range of the linear dewatering zone 12*a* on the lower side of the second wire 20, there is a group of wire support members 27–29, which is supported by the frame 29. The wire support members 27–29 are equipped with adjustable, flexible pressure members 28. The pressure caused by the members 27–28 against the wire is adjustable by means of the members 28. The upper side of the linear dewatering zone 12*a* correspondingly comprises dewatering foils 17 of conventional structure. The linear dewatering zone 12*a* is followed by a curved dewatering zone 12*b* on which web is conducted, determined by the radius of shoe curvature R, towards the first wire loop 10. The dewatering foils 18 on the upper side of the wires on the curved zone are arranged in a curved path determined by the radius of curvature R. On the linear dewatering zone 12*a*, the pressure between the wires 10 and 20 depends on the load effected by members 28, whereas on the curved zone 12*b*, the pressure between wires 10 and 20 depends on the wire tension and the radius of curvature R. The pick-up suction box 26, arranged after the curved zone 12*b*, is equipped with a curved guiding surface with radius R2 which is selected so that it smoothly picks the formed web W onto the surface of the second wire 20.

According to the invention, the dewatering unit 12 is mounted on the support structures with a shaft which is parallel with the wire and transverse with respect to the moving direction of the web W. According to FIG. 2, the said shaft P can be located either on the joint of the linear zone 12a and the curved zone 12b, at the downstream end P' of the curved zone 12b, or somewhere in the range of the curved zone 12b. The said universal shaft P or P' as the centerline, the dewatering unit 12 can be rotated within the limits of angles $\beta$ or $\beta'$. This rotation also affects the angle $\alpha$ between wires 10 and 20 in the linear dewatering zone.

The angle $\alpha$ between the wires 10 and 20 is thus easily adjustable by rotating the dewatering unit 12 and by adjusting roll 11a according to the thickness of the stock entering the wire gap. By means of adjustable wire supporting members 27–29 arranged on the linear dewatering zone 12a, the compression exerted against the web can be adjusted without any damages to the web. Due to these adjustments, the invention is suitable for very wide basis weight and speed ranges. Due to the curved zone 12b following the direct zone 12a, the method and apparatus according to the invention are essentially more suitable for high speeds compared to prior art solutions equipped with a corresponding dewatering zone. This is because on the curved zone 12b, where the dryness of the web W is higher than on the linear zone 12a, no friction-causing wire supporting members for the second wire loop 20 are needed. On the linear zone 12a, the water removed from stock functions as a lubricant reducing friction. The wire supporting members 27–29 on the direct zone 12a do not thus cause substantially high friction which could disturb the operation at higher speeds.

Figure 3:
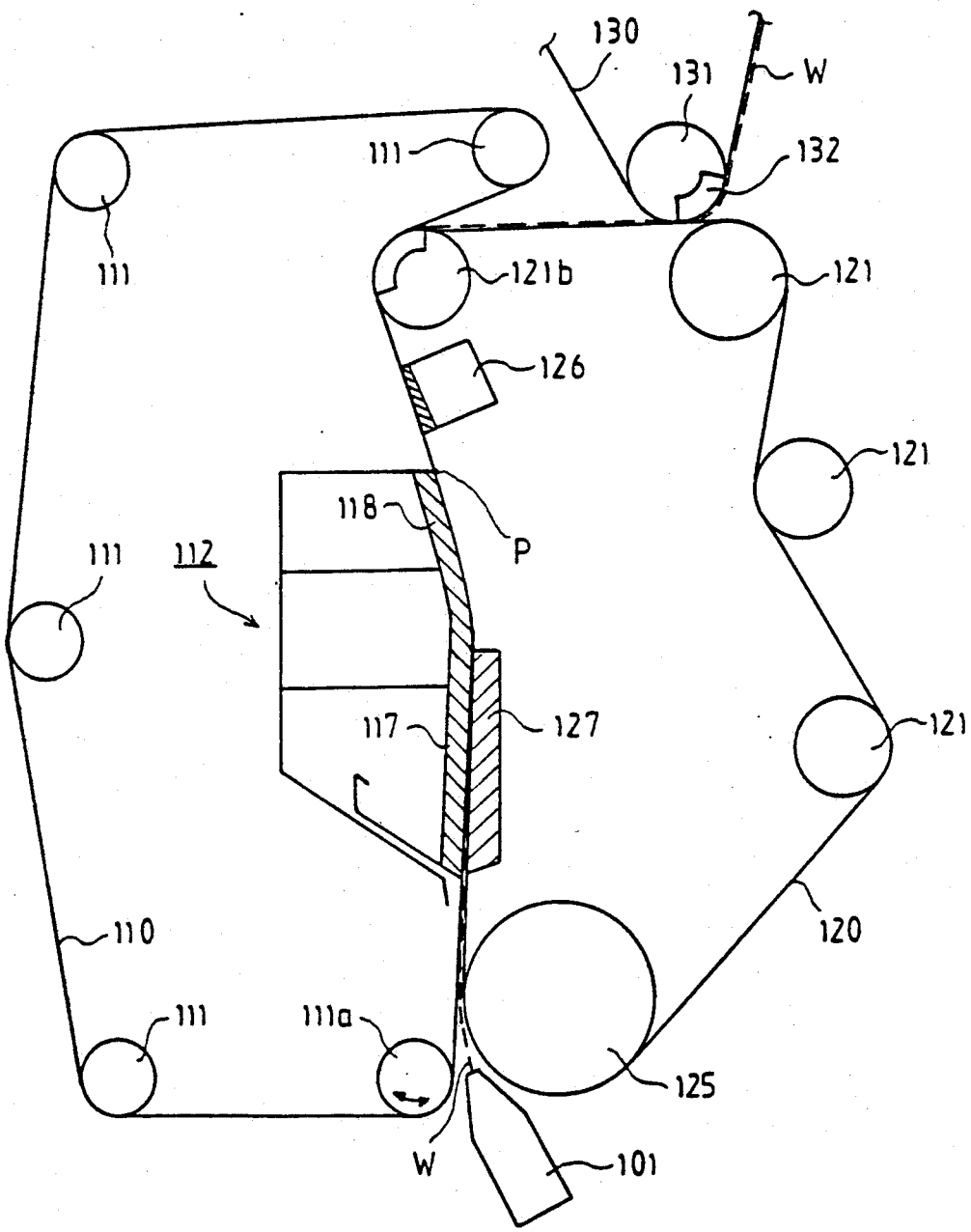
FIGS. 3 and 4 are alternative embodiments of the solution in FIG. 1.
Figure 4:
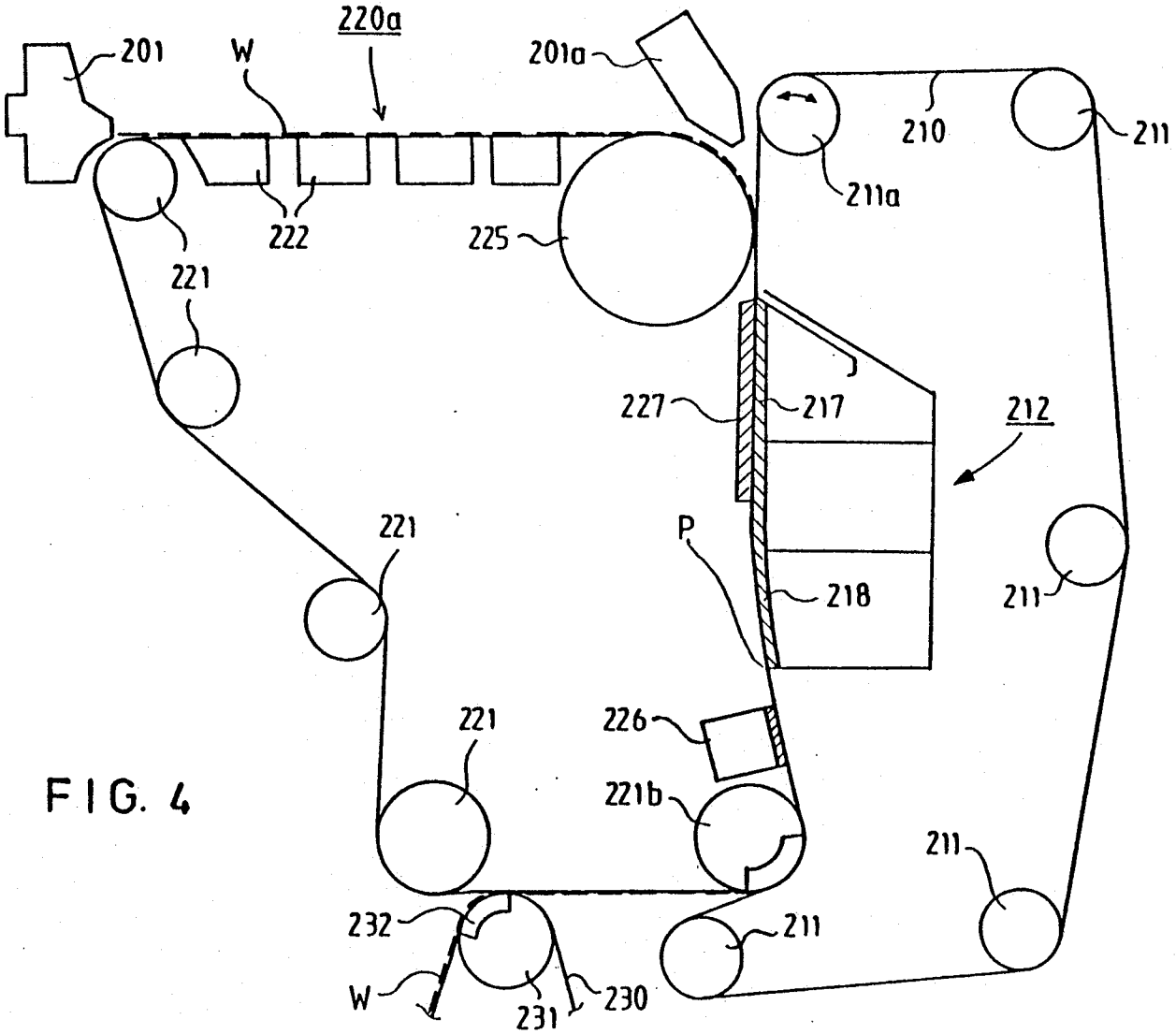

FIGS. 3 and 4 illustrate alternative embodiments of the solution in FIG. 1. In the solutions of FIGS. 3 and 4, the moving direction of the web W on the double wire section substantially deviates from the horizontal level, and, in the embodiment of FIG. 3, the said moving direction is upwards. In the embodiment of FIG. 3, the headbox 101 feeds stock directly into the gap between the first wire loop 110 and the second wire loop 120. The first wire loop 110 is guided by lead rolls 111 and an adjustable guide roll 111a. As in FIGS. 1 and 2, inside the first wire loop 110 a dewatering unit 112 is arranged, the structure and operation of which substantially corresponds to the above description. Thus, there is a linear zone in the range of the dewatering unit 112, the water removing side of which comprises dewatering rods 117 as well as a curved zone the suction side of which comprises dewatering rods 118. The second wire loop 120 is guided by lead rolls 121, a guide roll 125 and a suction roll 121b. In the embodiment of FIG. 3, the suction box 25 of the FIG. 2 is replaced by a guide roll 125 which can preferably be a suction roll. Additionally, the diameter of the guide roll 125 is so large that it smoothly guides the web to the range of the dewatering unit 112. The suction roll 121b ensures that the web W moves onto the surface of the second wire loop 120 after the double wire section. Additionally, FIG. 3 illustrates that on the linear zone of the dewatering unit 112, the second wire loop 120 is supported by wire support members 127 corresponding to the support members in FIG. 1, and FIG. 3 further illustrates that after the dewatering unit 112 a suction box 126 can be arranged to support the second wire loop by means of which the smooth travel of the web is ensured after the dewatering unit 112. As presented in FIG. 1, the formed web W is separated from the web forming section with a pick-up roll 131 equipped with suction zone 132 by means of which the web W is moved to the pick-up felt 130 and further to the press section of a paper machine. In the embodiment of FIG. 3, the web is guided, on the linear zone of the dewatering unit 112, towards the inside of the second wire loop, i.e. the moving direction of the web is deviated as presented in FIGS. 1 and 2. Additionally, in the embodiment of FIG. 3, with respect to the frame (not indicated), the dewatering unit 112 is mounted with a shaft P which is transverse with respect to the moving direction of web W. In the embodiment of FIG. 3, the shaft P is located at the end of the curved dewatering zone of the dewatering unit 112. It is, however, obvious that also in the embodiment of FIG. 3, the said shaft P can be arranged somewhere on the curved dewatering zone.

FIG. 4 presents another alternative embodiment for the invention in which the moving direction of the web is arranged substantially downwards on the double wire section of the web forming apparatus. In the embodiment of FIG. 4, the headbox 201 feeds stock onto the Fourdrinier section 220a which is supported by dewatering equipment 222. The Fourdrinier section 220a is a part of the second wire loop 220. After the Fourdrinier section 220a, the web W is conducted on the double wire section formed by the first wire loop 210 and the second wire loop 220. The first wire loop 210 is guided by lead rolls 211 as well as an adjustable guide roll 211a. Inside the first wire loop, a dewatering unit 212 is arranged the operation and structure of which correspond to the dewatering units 12 and 112 described earlier. The second wire loop 220 is guided by lead rolls 221, dewatering equipment 222 mentioned above, a guide roll 225 and a suction roll 221b. The purpose of the guide roll 225 is to guide the second wire loop 220 and the web W on it smoothly onto the double wire section, and, correspondingly, the purpose of the suction roll 221b is to guide the formed web from the double wire section onto the surface of the second wire loop 220. Furthermore, FIG. 4 presents that the equipment is furnished with a second headbox 201b by means of which stock can be conducted directly onto the double wire section. Thus, the embodiment of FIG. 4 can employ either one of the headboxes 201 or 201a, or both headboxes can be used simultaneously, whereby the fiber layer is formed layer by layer. In the dewatering range 212, there is the first, i.e. the linear dewatering zone and a curved dewatering zone after it, as described previously. On the linear dewatering zone, on which the first wire loop 210 is supported by dewatering foils 217, and the second wire loop 220 is supported by wire support members 227, the moving direction of the web is deviated in a certain angle towards the second wire loop 220. On the curved dewatering zone, on which the first wire loop 210 is supported by dewatering foils 218 in a determined radius of curvature, the moving direction of the web is guided to curve smoothly in such a way that the press between the wire loops depends on the said radius of curvature. After the dewatering unit, a suction box 226 can be arranged, the operation and structure of which have been described in connection with the previous embodiments. The web W formed on the web forming section is guided on the pick-up felt 230 by means of a pick-up roll 231 equipped with suction zone 232, and the pick-up felt 230 conducts the web W from the web forming section further to the press section (not indicated). In the embodiment of FIG. 4, too, the dewatering unit 212 is mounted on the frame with a shaft P which is transverse with respect to the web moving direction. The position of the dewatering unit 212 is adjustable with respect to the shaft P, as in the previous embodiments. Also in the embodiment of FIG. 4, the said shaft P can preferably be located on the curved zone of the dewatering unit 212.

The present invention has been described above, by way of example, with reference to the accompanying drawings. The invention is not, however, by any reference to the accompanying drawings. The invention is not, however, by any means limited to the examples illustrated in the figures but, within the scope of the inventional concept defined by the appended claims, several variations are possible.

I claim:

1. Apparatus for forming a fibrous paper or board web comprising a double wire section having a first wire loop and a second wire loop, said first and second wire loops engaging each other in said double wire section; at least one headbox for feeding a fiber suspension onto a Fourdrinier section upstream of said double wire section or from said headbox directly into said double wire section and between said first and second wire loops;

a dewatering unit inside said first wire loop and engaging said first wire loop on a side thereof facing away from said second wire loop and including means for applying an underpressure to remove water from said fiber suspension between said wire loops and through said first wire loop;

said dewatering unit having a first linear dewatering portion causing said first and second wire loops to move said fiber suspension in a linear direction away from said dewatering unit, and a second curved dewatering portion located immediately adjacent and downstream of said first linear dewatering portion causing said first and second wire loops to move said fiber suspension in a curved direction towards said dewatering unit, wherein said dewatering unit in said first linear dewatering portion deflects the direction of said suspension by an adjustable angle of deviation away from said dewatering unit, said apparatus including means for adjusting said angle of deviation comprising a shaft substantially adjacent said second curved dewatering portion and substantially level with said fiber suspension, at least a portion of said dewatering unit rotatable about said shaft to change said adjustable angle of deviation.

2. An apparatus according to claim 1 wherein said shaft is in the joint between said first linear dewatering portion and said second curved dewatering portion.

3. An apparatus according to claim 1, wherein said shaft is arranged at the end of said second curved dewatering portion.

4. An apparatus according to claim 1, further comprising wire support members within the second wire loop and associated adjustment means for adjustably loading said second wire loop in said first linear dewatering portion, and being devoid of any wire support members within the second wire loop opposite said second curved dewatering portion.

5. Apparatus for forming a fibrous paper or board web comprising a double wire section having a first wire loop and a second wire loop, said first and second wire loops engaging each other in said double wire section; at least one headbox for feeding a fiber suspension onto a Fourdrinier section upstream of said double wire section or from said headbox directly into said double wire section and between said first and second wire loops;

a dewatering unit inside said first wire loop and engaging said first wire loop on a side thereof facing away from said second wire loop and including means for applying an underpressure to remove water from said fiber suspension between said wire loops and through said first wire loop;

said dewatering unit having a first linear dewatering portion causing said first and second wire loops to move said fiber suspension in a linear direction away from said dewatering unit, and a second curved dewatering portion located immediately adjacent and downstream of said first linear dewatering portion causing said first and second wire loops to move said fiber suspension in a curved direction towards said dewatering unit;

a suction box upstream of said dewatering unit and inside said second wire loop, engaging said second wire loop on a side facing away from said first wire loop; and a plurality of adjustable wire supporting members within the second wire loop and opposite said first linear dewatering portion for exerting compression against said fibrous suspension in the direction of said first linear dewatering portion, said apparatus being devoid of any support members in the second wire loop opposite the second curved dewatering portion.

* * * * *